US006599101B2

(12) United States Patent
Matsuura et al.

(10) Patent No.: US 6,599,101 B2
(45) Date of Patent: Jul. 29, 2003

(54) GAS COMPRESSOR

(75) Inventors: Toshinari Matsuura, Chiba (JP); Tatsuhiro Tohyama, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/905,559

(22) Filed: Jul. 14, 2001

(65) Prior Publication Data

US 2002/0127121 A1 Sep. 12, 2002

(30) Foreign Application Priority Data

Mar. 12, 2001 (JP) ..... 2001-069288

(51) Int. Cl.[7] ..... F04B 39/16

(52) U.S. Cl. ..... 417/313; 418/DIG. 1; 184/6.16; 184/6.23

(58) Field of Search ..... 417/313; 184/6.16, 184/6.23; 418/DIG. 1

(56) References Cited

U.S. PATENT DOCUMENTS

| | | | | |
|---|---|---|---|---|
| 3,722,925 A | * | 3/1973 | Robbins | 285/341 |
| 3,776,668 A | * | 12/1973 | Abendschein | 418/97 |
| 4,255,099 A | | 3/1981 | Komori | 418/97 |
| 5,133,647 A | | 7/1992 | Herron et al. | 417/312 |
| 2001/0029727 A1 | * | 10/2001 | Iwanami et al. | 55/459.1 |

FOREIGN PATENT DOCUMENTS

| | | | |
|---|---|---|---|
| EP | 0600313 | 6/1994 | |
| EP | 600313 A1 * | 6/1994 | F04C/18/344 |
| GB | 2012874 | 8/1979 | |

OTHER PUBLICATIONS

Patent Abstracts of Japan, vol. 009, No. 306 (C–317), Dec. 3, 1985 publication No. 60143812, publication date Jul. 30, 1985.

* cited by examiner

*Primary Examiner*—Charles G. Freay
*Assistant Examiner*—Emmanuel Sayoc
(74) *Attorney, Agent, or Firm*—Adams & Wilks

(57) ABSTRACT

To provide a gas compressor that is suitable for reducing cost for the overall compressor without degrading the oil separation performance needed for the compressor and that may keep the oil separation performance constant for a long period of time. An oil separator having a pipe structure composed only of a discharge pipe formed integrally with a side block as a means for separating a lubricant oil component contained in high pressure cooling medium gas is adapted. In this case, the discharge pipe is adapted to form a discharge route for the high pressure cooling medium gas without any bypass immediately before an inner wall of a compressor case from a first discharge chamber. The separation of the lubricant oil component is performed by collision of the high pressure cooling medium gas, immediately after discharged from a cylinder discharge port to the first discharge chamber, against the inner wall of the compressor case through the discharge pipe without reducing a high flow rate.

23 Claims, 11 Drawing Sheets

FIG.5A
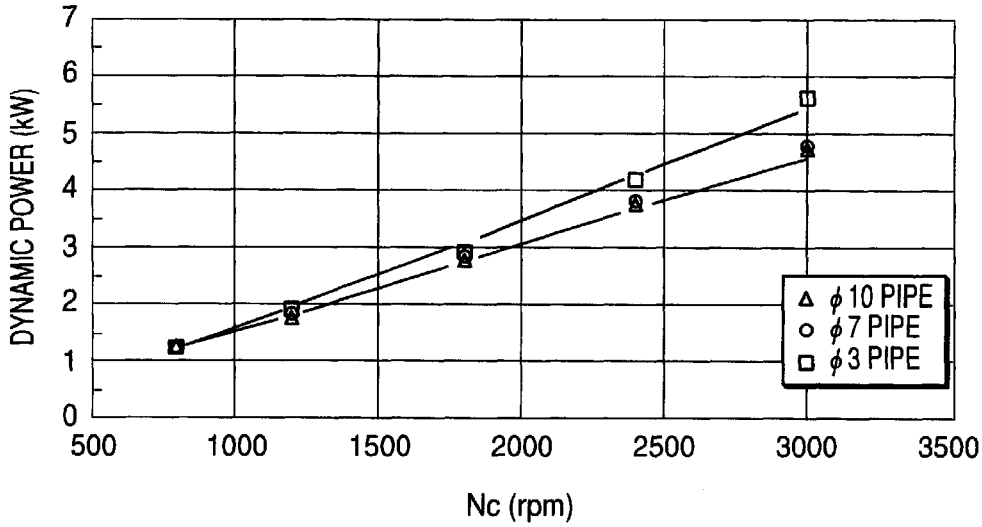
FIG.5B
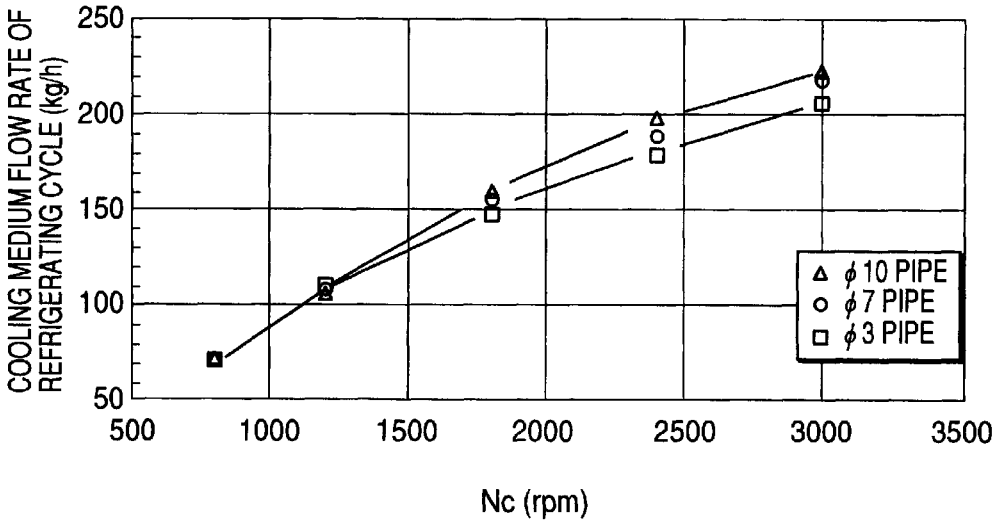
FIG.5C
CONDITION:Pd/Ps=1.37/0.196MPa(14/2Kg/cm$^2$G) SH/SC=10/5
| COOLING MEDIUM FLOW RATE OF REFRIGERATING CYCLE (kg/h) | | | | DYNAMIC POWER (kw) | | | |
|---|---|---|---|---|---|---|---|
| Nc | φ3 PIPE | φ7 PIPE | φ10 PIPE | Nc | φ3 PIPE | φ7 PIPE | φ10 PIPE |
| 800 | 72.1 | 73.1 | 74.2 | 800 | 1.20 | 1.20 | 1.18 |
| 1200 | 107.7 | 111.7 | 111.4 | 1200 | 1.85 | 1.85 | 1.80 |
| 1800 | 147.5 | 155.3 | 159.4 | 1800 | 2.94 | 2.77 | 2.75 |
| 2400 | 178.0 | 188.0 | 197.7 | 2400 | 4.18 | 3.79 | 3.74 |
| 3000 | 206.3 | 219.4 | 226.3 | 3000 | 5.62 | 4.78 | 4.75 |

Prior Art

Prior Art

GAS COMPRESSOR

BACKGROUND OF THE INVENTION

1. Field of the Invention

The present invention relates to a gas compressor assembled into an air-conditioning system for a vehicle or the like, and more particularly to a gas compressor in which it is possible to reduce a cost for the overall compressor without deteriorating its oil component separating function that is needed for the compressor, and to keep the oil component separating function constant for a long period of time.

In order to attain he above-described problems, a first object of the present invention is to provide a gas compressor that is suitable for reducing the overall manufacturing cost while attaining a reduction in the number of assembling steps and the parts relating to the oil separator. A second object of the present invention is to provide a gas compressor provided with an oil separator that is high in reliability to make it possible to keep a constant oil separation function that is needed for the compressor for a long period of time.

2. Description of the Related Art

In this kind of a conventional gas compressor, as shown in, for example, FIG. 11, a cylinder 2 having a substantially oval-shaped inner circumference is provided within a compressor case 1 and side blocks 3 and 4 are mounted at both end faces of the cylinder 2.

In order to achieve the above-mentioned objects according to the present invention, a gas compressor comprises a cylinder disposed in a compressor case, side blocks mounted on both end faces of the cylinder, a cylinder discharge port for discharging high pressure cooling medium gas which contains lubricant oil compressed in a compression chamber within the cylinder to a first discharge chamber that is an outside space of the cylinder, a second discharge chamber provided between an inner sealed end of the compressor and one of the side blocks, and an oil separator for separating lubricant oil component contained in the high pressure cooling medium gas to be introduced from the first discharge chamber to the second discharge chamber side. The oil separator is formed of a discharge pipe integral with one of the blocks and has an opening at one end to the first discharge chamber side with the other end opened toward an inner wall of the compressor case.

A rotor 7 is laterally provided inside the cylinder 2. The rotor 7 is supported rotatably through bearings 9 of the side blocks 3 and 4 and a rotor shaft 8 extending along the axis thereof. Also, as shown in FIG. 12, a plurality of slit-like vane grooves 11 are formed radially on the outer circumferential surface side of the rotor 7. Vanes 12 are mounted on these vane grooves 11 one by one. The vanes 12 are provided to be retractable and projectable from the outer circumferential surface of the rotor 7 toward the inner wall of the cylinder 2.

The interior of the cylinder 2 is partitioned into a plurality of small chambers by both surfaces at a tip end of each vane 12, outer circumferential surface of the rotor 7, inner surfaces of the side blocks 3 and 4 and the inner wall of the cylinder 2. The small chamber thus partitioned is a compression chamber 13. Such a compression chamber 13 within the cylinder 2 is rotated in a direction indicated by an arrow a in FIG. 12 to repeats the change in volume.

When the volume of the compression chamber 13 is changed, upon the increase of the volumes a low pressure cooling medium gas within the suction chamber 6 is sucked into the compression chamber 13 through suction inlets 15 of the side blocks 3 and 4 and suction passages 14 such as the cylinder 2. Then, when the volume of the compression chamber 13 is started to be reduced, the cooling medium gas of the compression chamber 13 is started to be compressed by the reduction in volume. Thereafter when the volume of the compression chamber 13 is close to the minimum level, a reed valve 17 of a cylinder discharge hole 16 provided at the oval short diameter portion of the cylinder is opened. Thus, the high pressure cooling medium gas within a compression chamber 10 is discharged to a first discharge chamber 18 of the outer space of the cylinder 1 from the cylinder discharge port 16 and further introduced through a gas passage 19 and an oil separator 20 to the side of the second discharge in chamber 5. In this case, lubricant is contained in the form of mist in the high pressure cooling medium gas discharged to the first discharge chamber 18. The lubricant oil component is separated by the collision with the oil separating filter 21 composed of metal mesh or the like for the oil separator 20.

Note that also as shown in FIG. 13, the lubricant oil component thus separated is dropped and reserved in an oil sump 22 of the bottom portion of the second discharge chamber 5. Also, the pressure of the high pressure cooling medium gas discharged into the second discharge chamber 5 is applied to the oil sump 22. The oil in the oil sump 22 to which such discharge pressure Pd is applied is fed to a back pressure chamber 25 of the bottom portion of the vane 12 passing through the side blocks 3 and 4, an oil hole 23 of the cylinder 1, the gap of the bearing 9 and a supply groove 24 formed in the surfaces, facing each other, of the side blocks 3 and 4 in this order.

However, in the above-described conventional gas compressor, as shown in FIG. 11, the side block 3 and the oil separator 20 are formed as discrete parts in view of the relationship of the structure in which the gas passage 19 for introducing to the oil separator 20 side the high pressure cooling medium gas containing the lubricant is formed between the mounting alignment surfaces of the side block 3 and the oil separator 20. For this reason, not only may a large number of parts such as an oil separator fastening bolt 26 (see FIG. 13) for mounting the oil separator 20 to the side block 3, a seal member for the mounting portion or the like be required, but also the assembling step for assembling the oil separator 20 to the side block 3 in the compressor manufacturing line. Thus, there are many factors for increasing cost, resulting in increase in cost for the overall compressor.

Also, in the above-described conventional gas compressor, as shown in FIG. 13, the oil separator 20 is fixed to the side block 3 by oil separator fastening bolts 26. Accordingly, if there is a defect due to the loosening of the oil separator fastening bolts 26, for example, when the loosening of the oil separator bolts 26, the mounting alignment surfaces of the side block 3 and the oil separator 20 are opened to split the gas passage 19, the high pressure cooling medium gas before the oil separation leaks to the outside of the gas passage 19 from the crack to cause the reduction of the oil separation property or the like. That is, there is a problem in that it is difficult to keep the constant oil separation function for a long period time.

SUMMARY OF THE INVENTION

In order to attain the above-described problems, a first object of the present invention is to provide a gas compressor that is suitable for reducing cost for overall equipment while attaining the reduction of the numbers of assembling steps and the parts relating to the oil separator, and a second object thereof is to provide a gas compressor provided with an oil separator that is high in reliability to make it possible to keep a constant oil separation function that is needed for the compressor for a long period of time.

In order to achieve the above-mentioned objects according to the present invention, a gas compressor comprising a cylinder disposed in a compressor case, side blocks mounted on both end faces of the cylinder, a cylinder discharge port for discharging high pressure cooling medium gas which contains lubricant oil compressed in a compression chamber within the cylinder to a first discharge chamber that is an outside space of the cylinder, a second discharge chamber provided between an inner sealed end of the compressor and one of the side blocks, and an oil separator for separating lubricant oil component contained in the high pressure cooling medium gas to be introduced from the first discharge chamber to the second discharge chamber side. The oil separator is formed of a discharge pipe integral with the one of the blocks and having an opening at one end to the first discharge chamber side and the other end opened toward an inner wall of the compressor case.

According to the present invention, the gas compressor is characterized in that the discharge pipe forms a discharge route of high pressure cooling medium gas without any bypass immediately before the inner wall of the compressor case from the first discharge chamber.

According to the present invention, the gas compressor is characterized in that the discharge pipe is composed of a straight tube extending linearly toward the inner wall of the compressor case from the first discharge chamber.

According to the present invention, the gas compressor is characterized in that the discharge pipe is opened at one end to the first discharge chamber side and at the same time opened toward the inner wall of the compressor case at the closest position immediately after the first discharge chamber.

According to the present invention, the gas compressor is characterized in that the one of the side blocks and the discharge pipe are cast integrally with each other.

According to the present invention, the gas compressor is characterized in that a means for forming the one of the side blocks integrally with the discharge pipe is adapted to take a structure in which a pipe press-fit hole in communication with the first discharge chamber is provided on the one of the side blocks, and one end of the discharge pipe is press-fitted in the pipe press-fit hole.

According to the present invention, the gas compressor is characterized in that a means for forming the one of the side blocks integrally with the discharge pipe is adapted to take a structure in which a screw hole in communication with the first discharge chamber is provided in the one of the side blocks, a screw portion is formed in an outer circumferential surface at one end of the discharge pipe, and the screw portion and the screw hole are engaged with each other and fastened and fixed to each other.

According to the present invention, the gas compressor is characterized in that a distance from an opening end on the side of inner wall side of a compressor of the discharge pipe to an inner wall of the compressor satisfies the following equation (1):

$$(\pi D^2/4) \leqq \pi DL \qquad \text{equation (1)}$$

where L is the distance, and D is the inner diameter of the opening end of the inner wall of the compressor case of the discharge pipe.

According to the present invention, the gas compressor is characterized in that the ratio of opening areas satisfies the following equation (2):

$$S_1/S_2 \geqq 0.7 \qquad \text{equation (2)}$$

Where $S_1$ is the opening area of the opening end on the side of the inner wall of the compressor case of the discharge pipe and $S_2$ is the opening area of the opening end on the side of the first discharge chamber of the discharge pipe.

According to the present invention, the high pressure cooling medium gas compressed in the compression chamber within the cylinder is discharged to the first discharge chamber in the outer space of the cylinder through the cylinder discharge port. The high pressure medium gas immediately after the discharge is collided against the inner wall of the compressor case through the discharge pipe while keeping a high flow rate. The lubricant oil component contained in the high pressure cooling medium gas is separated by this collision.

BRIEF DESCRIPTION OF THE DRAWINGS

FIG. 5A shows a test result of investigation of a mutual relationship between the diameter of the discharge pipe and the dynamic power of the gas compressor according to the present invention, FIG. 5B shows a test result of investigation of a mutual relationship between the diameter of the discharge pipe and a discharge flow rate of the high pressure cooling medium gas, and FIG. 5C is an explanatory view of actual measurement value of the two test results.

DETAILED DESCRIPTION OF THE PREFERRED EMBODIMENTS

Embodiments of a gas compressor according to the present invention will now be described with reference to FIGS. 1 to 10.

Figure 1:
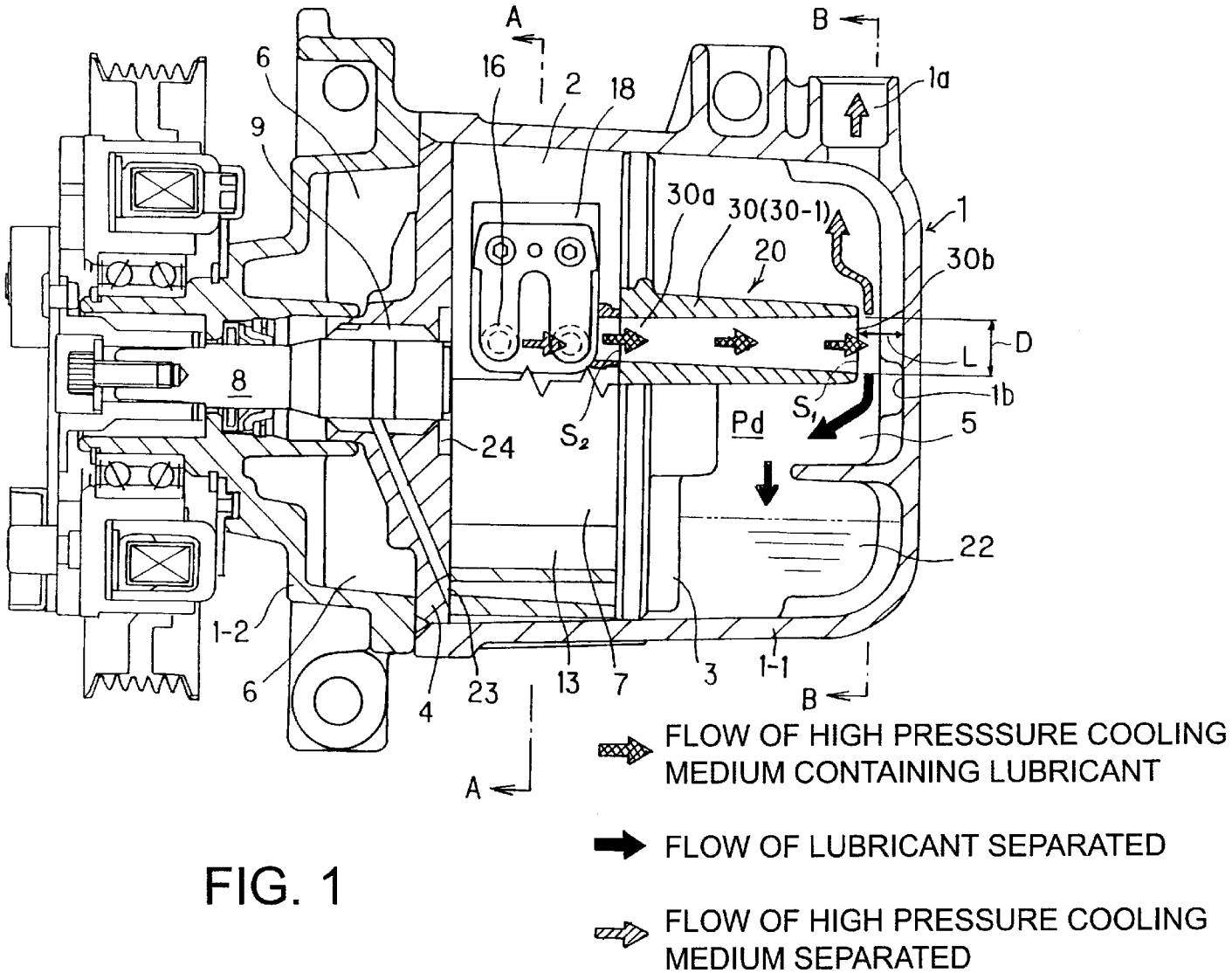
FIG. 1 is a cross-sectional view showing one embodiment of the present invention.

FIG. 1 is a cross-sectional view showing one embodiment of the gas compressor according to the present invention. The basic structure of this gas compressor such as the arrangement in which the cylinder 2 is disposed within the compressor case 1, the side blocks 3 and 4 are mounted at both end faces of the cylinder 2, and the second discharge chamber 5 is provided between one of the side blocks 3 and the inner sealed end of the compressor case 1 and the arrangement in which the high pressure cooling medium gas compressed in the compression chamber 13 within the cylinder 2 is discharged to the first discharge chamber 18 of the external space of the cylinder through the cylinder discharge port 16 and the like is the same as that of the conventional case. Accordingly, the same reference numerals are used to denote the same components and the detailed explanation thereof will be omitted.

Also in the gas compressor according to this embodiment, as shown in FIG. 1, the lubricant oil is contained in the form of mist in the high pressure cooling medium gas discharged into the first discharge chamber 18. The high pressure cooling medium gas containing the lubricant oil is introduced to the side of the second discharge chamber 5. The oil separator 20 of a pipe structure is adapted in this embodiment as a means for separating the lubricant oil component in the form of mist from the high pressure cooling medium gas as follows.

The oil separator 20 according to this embodiment is composed of a discharge pipe 30 formed integrally with the side block 3 as a part of the side block 3 on a rear side. This discharge pipe 30 is opened at one end on the side of the first discharge chamber 18 and is opened at the other end toward the inner wall of the compressor case 1. Also, in this embodiment, a straight tube 30-1 is used as such a discharge pipe 30. This straight tube 30-1 is formed integrally with one of the side blocks 3 and at the same time adapted to extend in a straight line toward the inner wall of the compressor case 1 from the first discharge chamber 18. Also, one end 30*a* of the discharge pipe 30 is opened on the side of the first discharge chamber 18 but the other end 30*b* of the discharge pipe 30, i.e., the opening end on the side of the inner wall of the compressor case of the discharge pipe 30 is formed to reach immediately before the inner wall 1*b* of the compressor case.

That is, in this embodiment, the discharge pipe 30 in the form of such a straight tube 30-1 as described above is adapted to form a linear discharge route for the high pressure cooling medium gas without any bypass immediately before the inner wall 1*b* of the compressor case from the first discharge chamber 18.

The reason why the structure for avoiding the bypass for the discharge route as described above is adapted is that it is possible to prevent the flow rate of the high pressure cooling medium gas from being decreased due to the bypass and to cause the high speed high pressure cooling medium gas to collide against the inner wall 1*b* of the compressor case to thereby effectively separate the lubricant oil component contained in the high pressure cooling medium gas.

Also, in this embodiment, as described above, the other end 30*b* of the discharge pipe 30 is adapted to reach immediately before the compressor case inner wall 1*b*. The reason why such a structure is adapted is that in order to enhance the oil separation function, the high pressure cooling medium gas that has the possibly highest flow rate is caused to collide against the inner wall of the compressor case 1, and the possibly largest amount of the high pressure cooling medium gas is caused to collide against the inner wall of the compressor case 1.

That is, comparing the flow rate of the high pressure cooling medium gas flowing out immediately after the discharge pipe 30 with that at a position away from this, the flow rate flowing immediately after the discharge pipe 30 is in the highest level. For this reason, in order to cause the high pressure cooling medium gas at a high flow rate to collide against the compressor case inner wall 1*b*, it is preferable to adapt the structure in which the other end 30*b* of the discharge pipe 30 reaches immediately before the compressor case inner wall 1*b*. Also, if the distance L from the other end 30*b* of the discharge pipe 30 to the compressor case inner wall 1*b* is too long, it is considered that a part of the high pressure cooling medium gas injected from the discharge pipe 30 is diffused into the second discharge chamber 5 before the collision against the compressor case inner wall 1*b*, resulting in decreasing of the amount of collision of the high pressure cooling medium gas to the compressor case inner wall 1*b*. Accordingly, in order to cause the larger amount of high pressure cooling medium gas collide against the compressor case inner wall 1*b*, it is preferable to shorten the distance from the other end 30*b* of the discharge pipe 30 to the compressor case inner wall 1*b*.

Incidentally, only in view of the enhancement of the oil separation performance, as described above, it is preferable to shorten the distance L from the other end 30*b* of the discharge pipe 30 to the compressor case inner wall 1*b*. However, if the distance L is too short, there is a problem in that the dynamic power for the gas compressor is increased and the cooling efficiency is lowered. The reason for this would be that the compressor case inner wall 1*b* would become large resistance when the high pressure cooling medium gas is injected from the other end 30*b* of the discharge pipe and the discharge amount of injected high pressure cooling medium gas from the other end 30*b* of the discharge pipe would be reduced. Accordingly, there is a constant lower limit for the above-described distance L in view of the relationship between the dynamic power and the cooling ability of the gas compressor. The lower limit for this distance L will now be described.

From the basic point of view, it is considered that, if a discharge flow passage for the high pressure cooling medium gas having the same or larger opening area as the opening area of such other end 30*b* of the discharge pipe may be secured on the side of such other end 30*b* of the discharge pipe that becomes the discharge port for the high pressure cooling medium gas, the discharge of the high pressure cooling medium gas from the other end 30*b* of the discharge pipe is smooth, and the degradation in cooling ability or the increase of the dynamic power of the gas compressor would be small to be negligible.

Accordingly, a cylindrical gap having the same diameter as the inner diameter D of the other end 3*b* of the above-described discharge pipe is present between the other end 30*b* of the discharge pipe and the compressor case inner wall 1*b*. The portion of the outer circumferential surface of this cylindrical gap becomes the discharge passage for the high pressure cooling medium gas. Therefore, if the outer circumferential surface area ($=\pi DL$) of the cylindrical gap is at least equal or more than the opening area ($=\pi D^2/4$) of such other end 30*b* of the discharge pipe, i.e., the following equation (1) is satisfied, there is no problem that the dynamic power or the cooling ability of the gas compressor is increased is degraded.

$$(\pi D^2/4) \leqq \pi DL \qquad \text{equation (1)}$$

D: the inner diameter of the other end 3*b* of the discharge pipe

L. the distance from the other end 30*b* of the discharge pipe to the compressor case inner wall 1*b*.

Accordingly, the lower limit for the distance L from the other end 30*b* of the discharge pipe to the compressor case inner wall 1*b* is D/4 from the equation (1). Note that, the upper limit for this distance L is determined from the relationship with the oil separation performance needed for the gas compressor. This is the reason why the longer the distance, the collision amount of the high pressure cooling medium gas to the compressor case inner wall 1*b* will become decreased as described above where by the oil separation performance would be degraded.

Assuming that $S_1$ is the opening area of such other end 30*b* of the discharge pipe 30 (opening end on the side of the compressor case inner wall) and $S_2$ is the opening area of one end 30*a* of the discharge pipe (opening end on the side of the first discharge chamber), the opening area ratio ($S_1/S_2$) will now be described. It is preferable that this opening area ratio ($S_1/S_2$) meet the following equation (2).

$$S_1/S_2 \geqq 0.7 \qquad \text{equation (2)}$$

In principle, in the case where the opening area ratio ($S_1/S_2$) is not more than one, the opening of the other end 30*b* of the discharge pipe that is the discharge port for the high pressure cooling medium gas is narrower than the opening of one end 30*a* of the discharge pipe. It is therefore difficult to discharge the high pressure cooling medium gas from the other end 30*b* of the discharge pipe. The discharge flow rate of the high pressure cooling medium gas is reduced. It is therefore considered that the dynamic power for the gas compressor is increased and the cooling ability is degraded. In particular, if the opening area ratio ($S_1/S_2$) is not greater than 0.7, the phenomenon that the dynamic power of the gas compressor is increased and the cooling ability is degraded becomes remarkable. Note that, the opening area ratio ($S_1/S_2$) is not less than one, since the opening of the other end 30*b* of the discharge pipe that is the discharge port for the high pressure cooling medium gas is certainly wider than the opening of one end 30*a* of the discharge pipe, there is no phenomenon that it is difficult to discharge the high pressure cooling medium gas from the other end 30*b* of the discharge pipe or the phenomenon that the discharge flow rate of the high pressure cooling medium gas is decreased. Accordingly, there is no fear that the dynamic power of the gas compressor is increased and the cooling ability is degraded. Accordingly, there is the lower limit of 0.7 for the opening area ratio ($S_1/S_2$) but there is only a limit in design caused due to the relationship with the equipment dimension for the upper limit of the opening area ratio ($S_1/S_2$). It is theoretically infinite.

As described above, in order to form the discharge pipe 30 integrally with one of the side blocks 3, it is sufficient to cast one of the side blocks 3 and the discharge pipe 30 to be integral with each other in this embodiment, one of the side blocks 3 and the discharge pipe 30 are formed integral with each other as a cast article.

Figure 2:
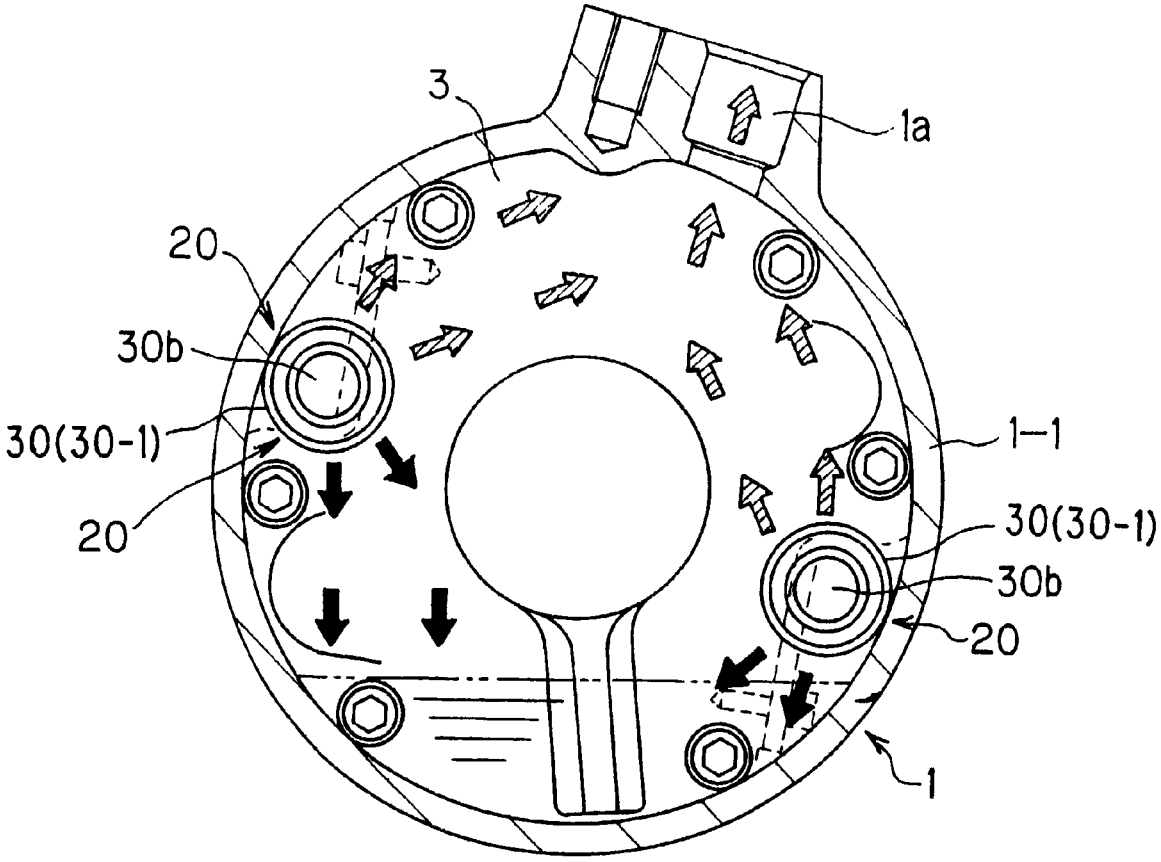
FIG. 2 is a view in the direction indicated by an arrow B in FIG. 1.
Figure 13:
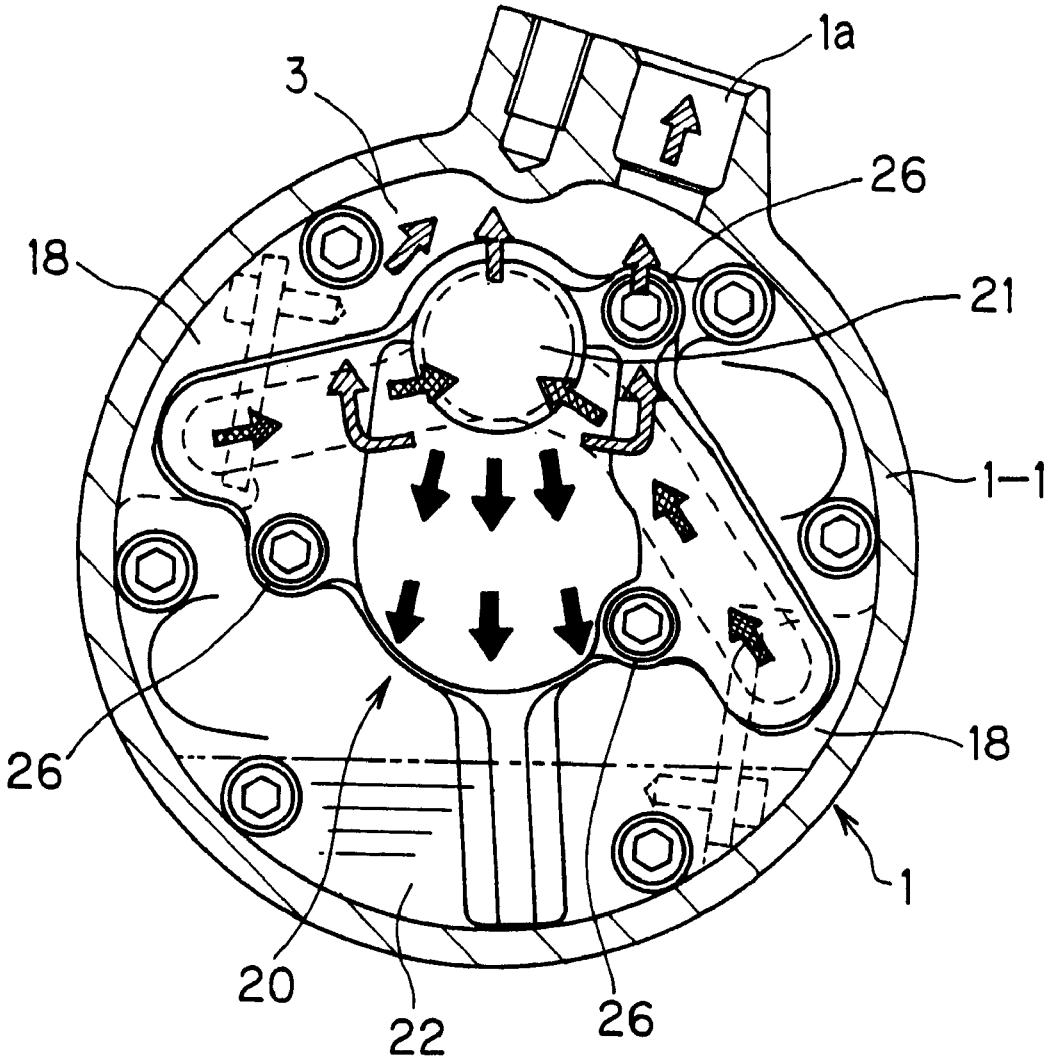
FIG. 13 is a cross-sectional view taken along the line 13—13 of FIG. 11.

Also, referring now to FIG. 13, in the gas compressor according to this embodiment, such a structure is adapted that the suction and compression strokes are completed within the range of zero to 180 degrees in terms of the rotational angle of the rotor 7 and the suction and compression strokes are also completed within the next range of 180 to 360 degrees. The two, in total, discharge portions composed of the cylinder discharge ports 16, the first discharge chambers 18 and the like are provided in diametrically opposite positions at 180 degrees with respect to the rotor shaft 8 one by one, respectively. As shown in FIG. 2, due to the relationship where the two discharge portions including such first discharge chambers 18 are present in this embodiment, the two discharge pipes 30 are provided in diametrically opposite positions by 180 degrees with respect to the rotor shaft 8 one by one, respectively.

The operation of the thus constructed gas compressor in accordance with this embodiment will now be described with reference to FIGS. 1 and 2.

In the gas compressor in accordance with this embodiment, as shown in FIG. 1, the high pressure cooling medium gas compressed in the compression chamber 13 (see FIG. 13) within the cylinder 2 is discharged through the cylinder discharge port 16 to the first discharge chamber 18. The high pressure cooling medium gas immediately after the discharge is caused to collide against the inner wall of the compressor case 1 through the discharge pipe 30 at a high flow rate. This collision makes the lubricant oil component, contained in the high pressure cooling medium gas, separated from the high pressure cooling medium gas.

Also, in the gas compressor in accordance with this embodiment, as shown in FIG. 2, since the two discharge pipes 30 and 30 are provided in diametrically opposite positions by 180 degrees with respect to the rotor shaft 8, the high pressure cooling medium gas discharged from the two discharge pipes 30 and 30 would collide with each other. The lubricant oil component contained in the high pressure cooling medium gas is separated also by the collision of the gas.

Incidentally, in the same manner as in the conventional case, the lubricant oil component separated as described above is dropped and reserved in the oil sump 22 at the bottom portion of the second discharge chamber 5. Also, the high pressure cooling medium gas after the oil separation is caused to flow and fed on the external air conditioning system side through the external discharge port 1*a* of the compressor case 1 from the second discharge chamber 5.

Figure 12:
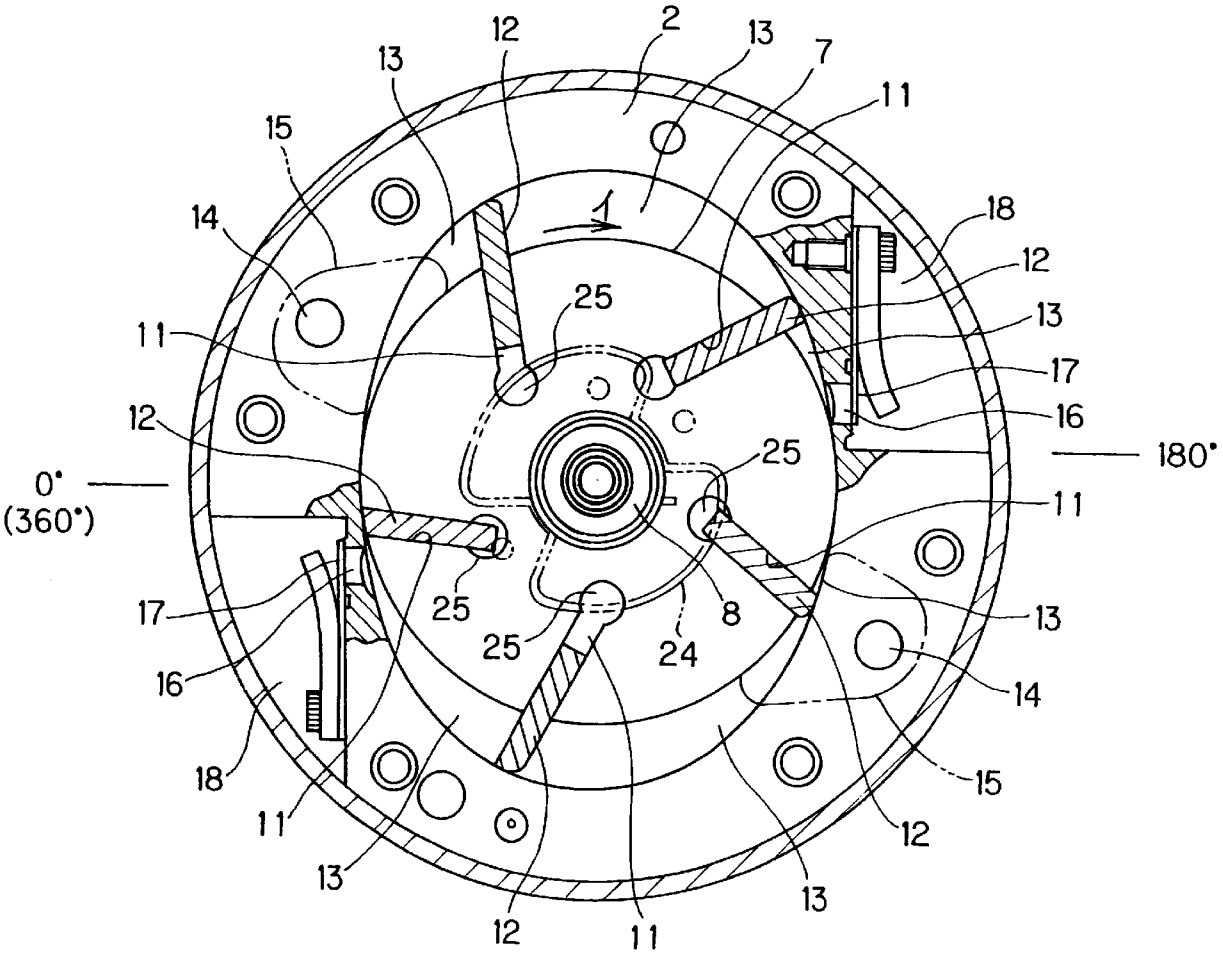
FIG. 12 is an enlarged sectional view taken along the line 12—12 of FIG. 11.

As described above, in the gas compressor in accordance with this embodiment, the oil separator 20 having the pipe structure composed of the discharge pipe 30 integrally formed with the side block 3 is adapted. Accordingly, in view of this structure, it is possible to dispense with the seal members such as the oil separation filter 21, the oil separator fastening bolts 26, the O-ring and the like unlike the structure of the conventional oil separator 20 shown in FIG. 12. It is therefore possible to reduce the number of these parts and reduce the number of the steps for oil separator assembling in the manufacturing line for the compressor.

Also, in the gas compressor in accordance with this embodiment, since the side block 3 and the discharge pipe 30 are formed into an integral cast article, there is no portion from which the high pressure cooling medium gas leaks or in which the oil separator fastening bolts 26 are loosened as in the conventional oil separator 20. Since the discharge route for the high pressure cooling medium gas without any bypass immediately before the inner wall of the compressor case 1 from the first discharge chamber 18, the high pressure cooling medium gas at a high flow rate is caused to collide against the inner wall of the compressor case 1 through this discharge route and the like, it is possible to effectively separate the lubricant oil component contained in the high pressure cooling medium gas and at the same time to keep the oil separation performance thereof constant for a long period of time.

Figure 3A:
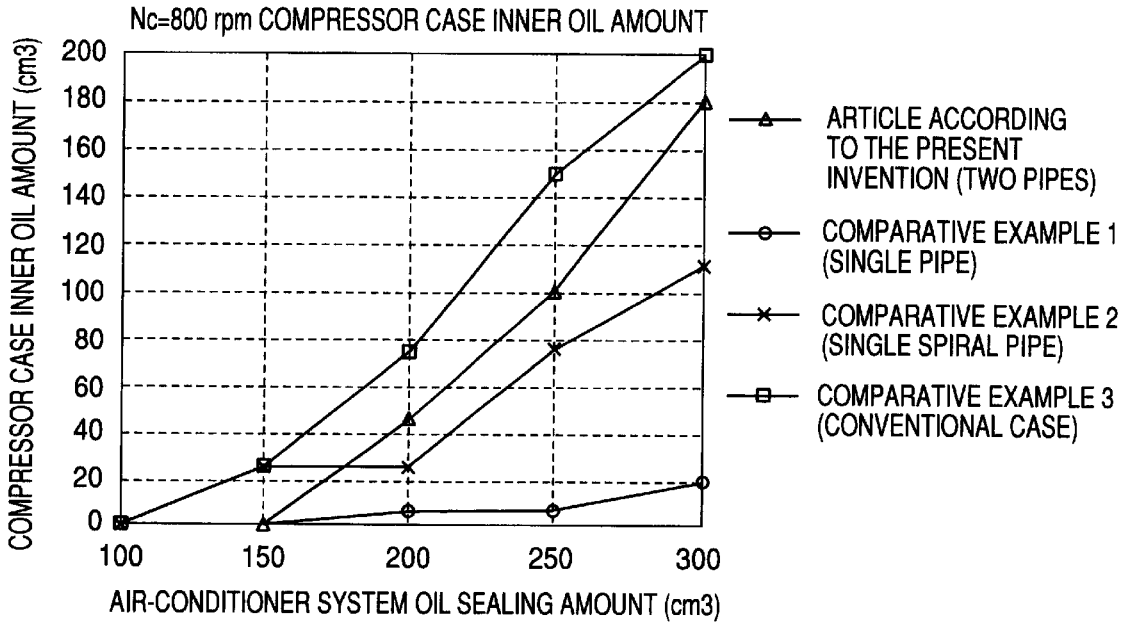
FIG. 3 is explanatory views for showing comparison test results of oil separation performance between the article according to the present invention and the comparative examples.
Figure 3B:
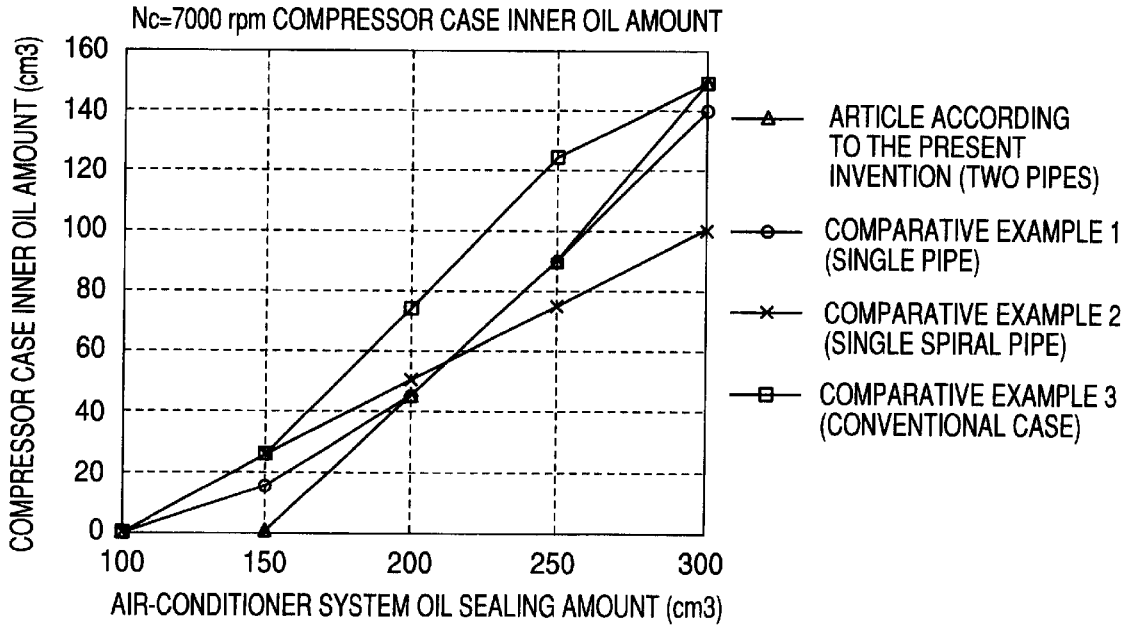

FIG. 3 shows the comparison test results of the oil separation performance between the product according to the present invention and the comparative example. FIG. 3A shows the result of the investigation of the oil amount within the compressor case at the compressor rpm (hereinafter referred to as "Nc"=800 rpm, and FIG. 3B shows the result of the investigation of the oil amount within the compressor case at the compressor "Nc"=700 rpm.

Here, briefly explaining the objects to be tested, the article according to the present invention is directed to the oil separator structure having the two discharge pipes as in the above-described embodiment, the comparative example 1 is directed to the structure in which the two discharge pipes are unified into one on the way, the comparative example 2 is directed to the structure in which the discharge pipe is provided in a spiral form in a long length and the comparative example 3 is directed to the conventional oil separator structure provided with the oil separator filter composed of metal mesh.

With the comparison test result of FIG. 3, comparing the discharge pipe structure as in the article according to the present invention or the comparative examples 1 and 2 with the conventional oil separator filter structure composed of the metal mesh as in the comparative example 3, although the amount of oil within the compressor case was smaller in the former case, the amount of oil within the compressor case was largest in the article according to the present invention comparing the discharge pipe structures with each other and showed the value similar to that of the oil separator filter structure made of metal mesh (comparative example 3). From this, in the case where the structure is directed to the discharge pipe structure of the oil separator, it is safe to say that the form provided with the two discharge pipe according to the article of the present invention is an optimum form in view of the enhancement of the oil separation function.

FIG. 4 shows the test result for investigation of the mutual relationship between the diameter and the oil separation performance of the discharge pipe in the above-described article of the present invention and the mutual relationship between the distance from the other end of the discharge pipe to the inner wall of the compressor case and the oil separation performance.

Figure 4A:
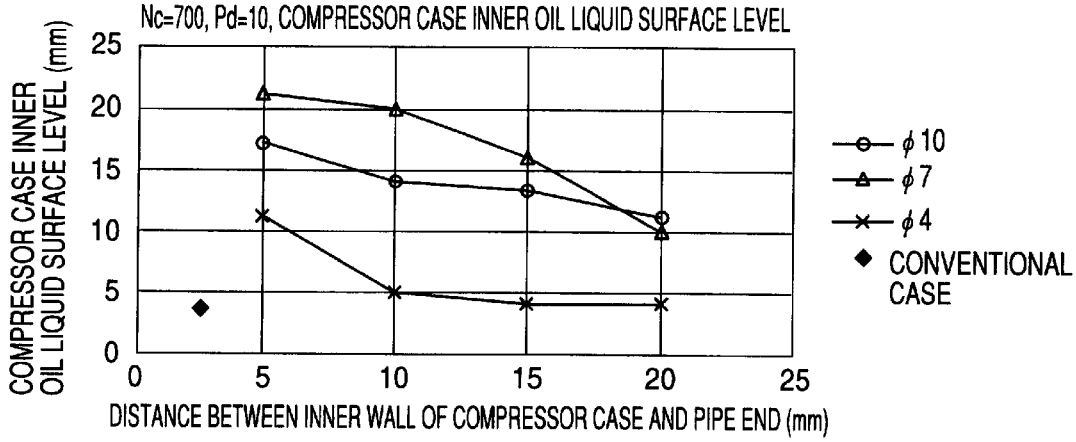
FIG. 4 is explanatory views for showing test results of investigation of a mutual relationship between a diameter of a discharge pipe and oil separation performance and a mutual relationship between a distance from the other end of the discharge pipe to an inner wall of a compressor case and the oil separation performance.
Figure 4B:
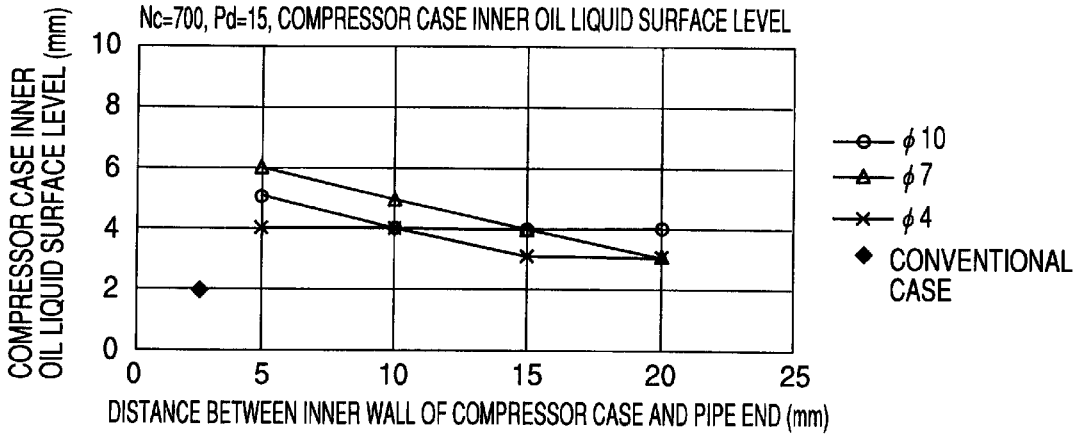
Figure 4C:
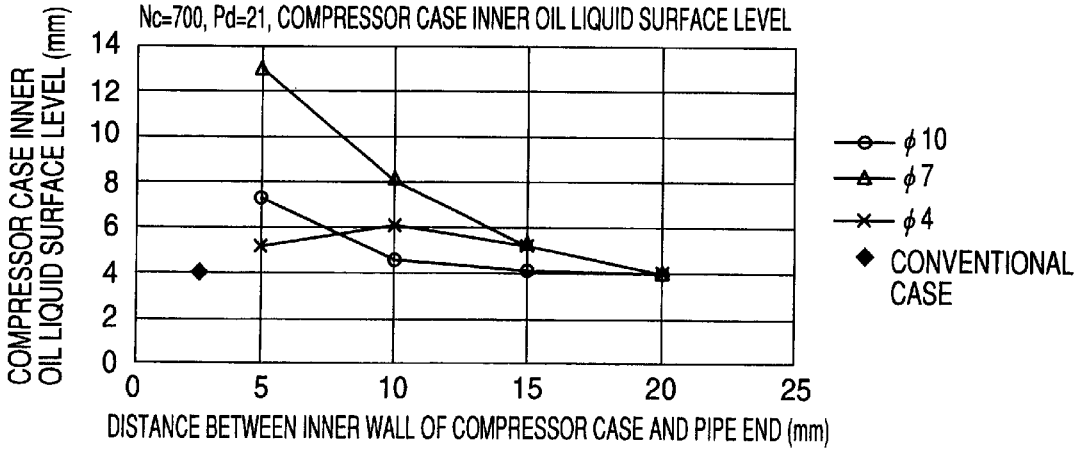

Note that, in the drawings, ϕ10, ϕ7 and ϕ4 show the diameters of the discharge pipe. Also, FIG. 4A shows the result of the investigation of the oil amount within the compressor case in terms of the height of the oil surface level when Nc=700 rpm and discharge pressure Pd=10 kgf/cm$^2$G, also, FIG. 4B shows the result of the investigation of the oil amount within the compressor case in terms of the height of the oil surface level when Nc=700 rpm and discharge pressure Pd=15 kgf/cm$^2$G, and FIG. 4C shows the result of the investigation of the oil amount within the compressor case in terms of the height of the oil surface level when Nc=7,000 rpm and discharge pressure Pd=21 kgf/cm$^2$ G. In each of FIGS. 4A, 4D and 4C, although the oil surface height within the conventional compressor case is plotted, the abscissa position is determined for the sake of convenience for comparison of the oil surface level with the other. Since there is no pipe in the conventional case, there is no concept of the distance between the pipe end and the inner wall of the compressor case.

As is apparent from the test result of FIG. 4, comparing the oil amounts within the compressor case with each other for every diameter of the discharge pipe, it will be understood that the oil amount within the compressor case is the largest in the case where the discharge pipe having ϕ7 is used. Accordingly, in order to enhance the oil separation performance, the discharge pipe having approximately ϕ7 is optimal.

Also, in view of the mutual relationship between the oil separation performance and the distance L from the other end 30*b* of the discharge pipe to the compressor case inner wall 1*b* from the test result of FIG. 4, it will be understood that, in this test, when the distance L is 5 mm, the oil amount within the compressor case is considerably increased in comparison with the conventional case (the conventional gas compressor shown in FIG. 12), and there is a tendency that the longer the distance L, the smaller the oil amount within the compressor case will become. Also, it will be understood that the distance L never falls out of the range of 10 to 15 mm in order to obtain more excellent oil separation performance than that in the conventional case (see FIG. 4C). Accordingly, it is possible to obtain the more excellent oil separation performance than that in the conventional case without fail if the distance falls within the range of 5 mm to 10 mm.

Furthermore, if the distance from the other end of the discharge pipe to the inner wall of the compressor case is kept constant, it has been found that the length of the discharge pipe no longer affect the oil separation performance.

FIG. 5A shows the test result of the investigation of the mutual relationship between the diameter of the discharge pipe and the dynamic power of the gas compressor in the above-described article of the present invention, FIG. 5B shows the test result of the investigation of the mutual relationship between the diameter of the discharge pipe and the cooling medium flow rate of the refrigerating cycle in the above-described article of the present invention, and FIG. 5C shows the actual measurement values of the two test results. Note that, the cooling medium flow rate of the refrigerating cycle is in close relation with the cooling ability of the gas compressor. As the flow rate of the cooling medium of the refrigerating cycle is high, the cooling ability is high. As the flow rate is low, the cooling ability is low. Accordingly, in the present test, as the means for making a judgement for the cooling ability, the flow rate of the cooling medium of the refrigerating cycle was measured.

Also, in the drawings, ϕ10 pipe means the pipe using the discharge pipe 30 having the opening diameter of 10 mm at the other end 30*b* (opening end on the side of the inner wall of the compressor case), and in the same manner, ϕ7 pipe and ϕ3 pipe mean the pipes using the discharge pipes 30 having opening diameters of 7 mm and 3 mm, respectively. In this case, in any discharge pipes 30, the opening diameter of the one end 30*a* (opening end on the side of the first discharge chamber) is 10 mm. Also, the test condition of the same drawings were that Nc=800 to 3,000 rpm, the discharge pressure Pd=1.37 Mpa (14 kgf/cm$^2$G), the suction pressure Ps=0.196 Mpa (2 kgf/cm$^2$G), super heating degree SH=10 deg. and super cooling degree SC=5 deg.

As is apparent from FIG. 5A, it was found that the dynamic power of the gas compressor was smaller when using the thick discharge pipe (ϕ10 pipe). Also, as is apparent from FIG. 5B, the cooling medium flow rate of the refrigerating cycle was higher when using the thick discharge pipe (ϕ10 pipe). Accordingly, it is understood that the cooling ability of the gas compressor is higher when using the discharge pipe (ϕ10 pipe).

Also, referring to FIG. 5, taking into consideration the dynamic power and the cooling ability of the gas compressor on the basis of the opening area ratio of one end 3*a* of the discharge pipe with the opening area of the other end 30*b* of the discharge pipe, in case of ϕ10 pipe where the opening area ratio is 1.0 at maximum, it is understood that the dynamic power of the gas compressor is the smallest and the cooling ability of the gas compressor is the best. It is understood that the increase of the dynamic power of the gas compressor and the degradation of the cooling ability will occur as the opening area ratio is gradually decreased from 0.7 (the opening area ratio in case of ϕ7 pipe) to 0.3 (the opening area ratio in case of ϕ3 pipe). Accordingly, in view of this test result, in order to prevent the degradation of the cooling ability and the increase of the dynamic power of the gas compressor, it is preferable to select the above-described opening area ratio in the range of 0.7 to 1.0.

Note that, in the above-described embodiment, the side block 3 and the discharge pipe 30 are cast integrally with each other. However, it is possible to use the press-fit integral structure as shown in, for example, FIG. 6 and a screw fastening structure shown in FIG. 7 in addition to the integral cast structure as the integral forming means for the side block 3 and the discharge pipe 30.

Figure 6:
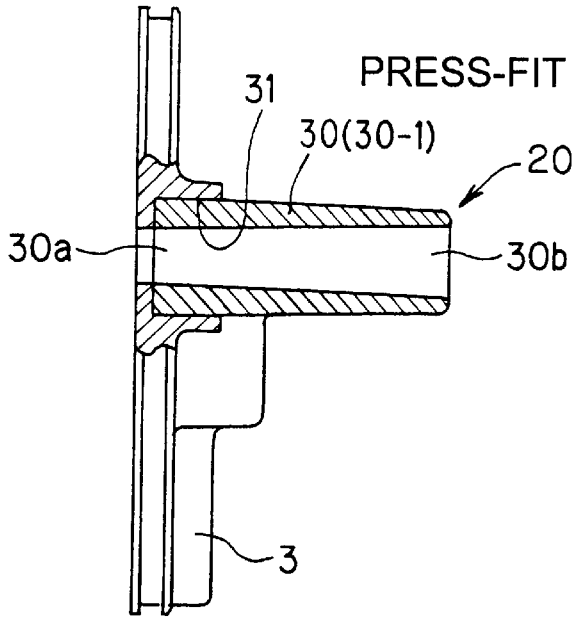
FIG. 6 is an explanatory view showing a primary part of another embodiment of the present invention.

In the press-fit structure shown in FIG. 6, a pipe press-fit hole 31 in communication with the first discharge chamber 18 is formed in one of the side blocks 3, and at the same time, one end 30*a* of the discharge pipe 30 is press-fit in this pipe press-fit hole 31.

Figure 7:
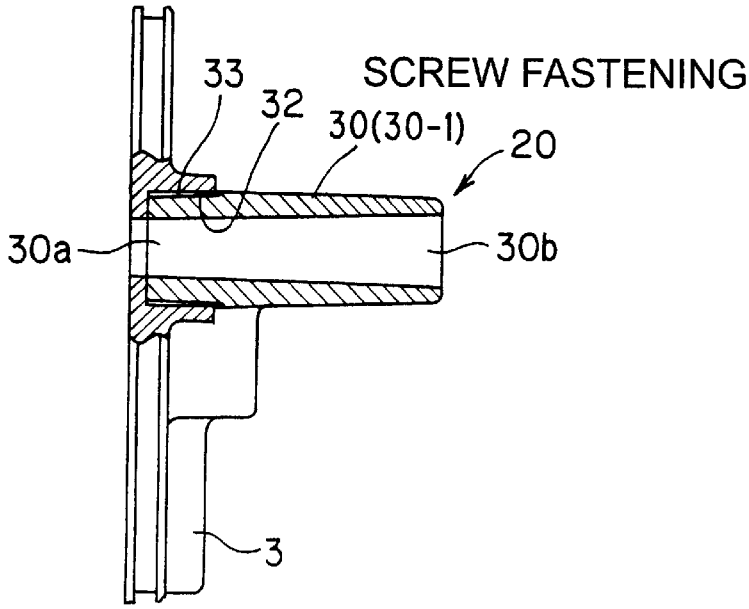
FIG. 7 is an explanatory view showing a primary part of another embodiment of the present invention.

In the screw fastening structure shown in FIG. 7, a screw hole 32 in communication with the first discharge chamber 18 is formed in one of the side blocks 3, whereas a screw portion 33 is formed on an outer circumferential surface at one end 30*a* of the discharge pipe 30. This screw portion 33 and the above-described screw hole 32 are engaged with each other for fastening.

Figure 8:
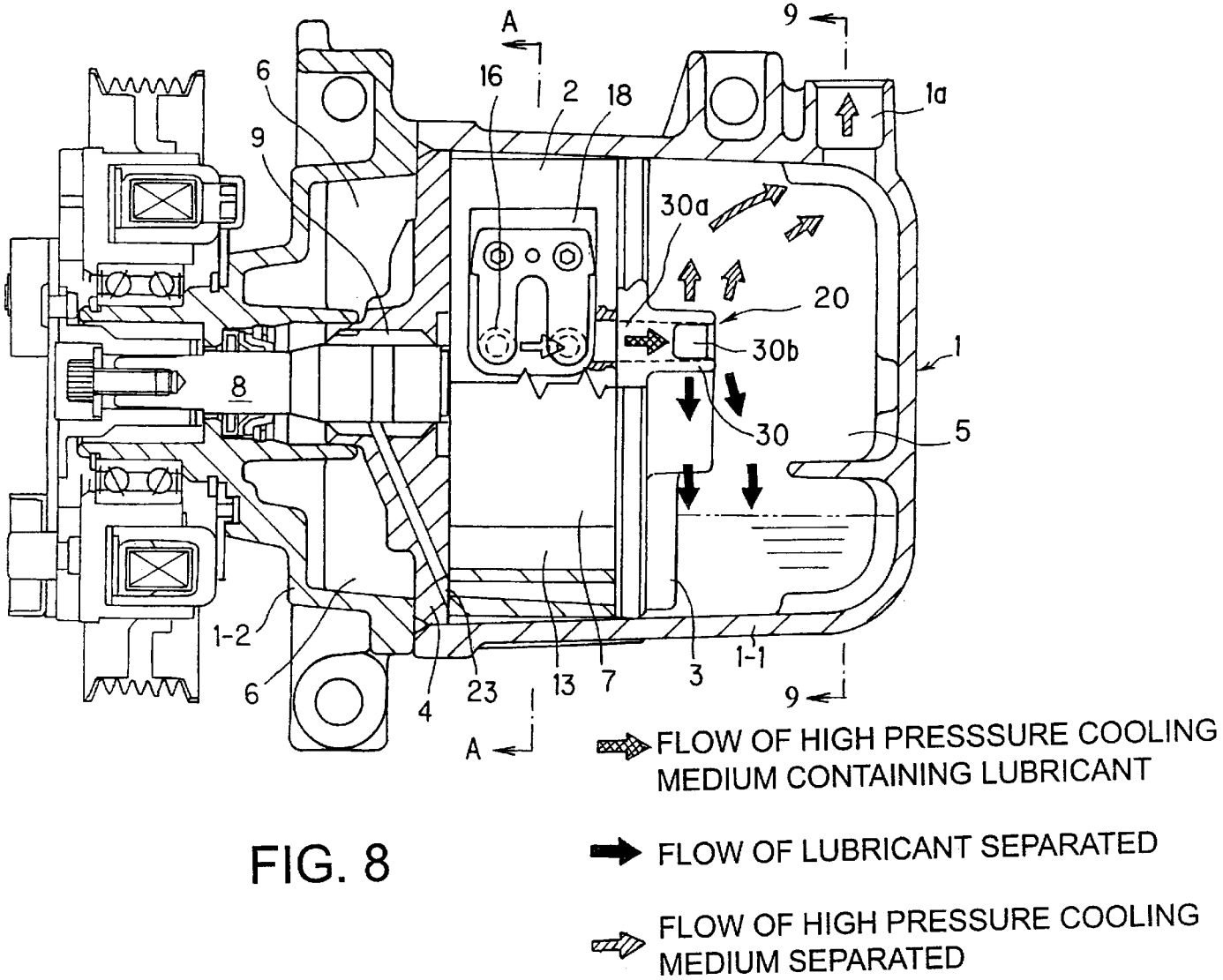
FIG. 8 is a cross-sectional view of another embodiment of the present invention.
Figure 9:
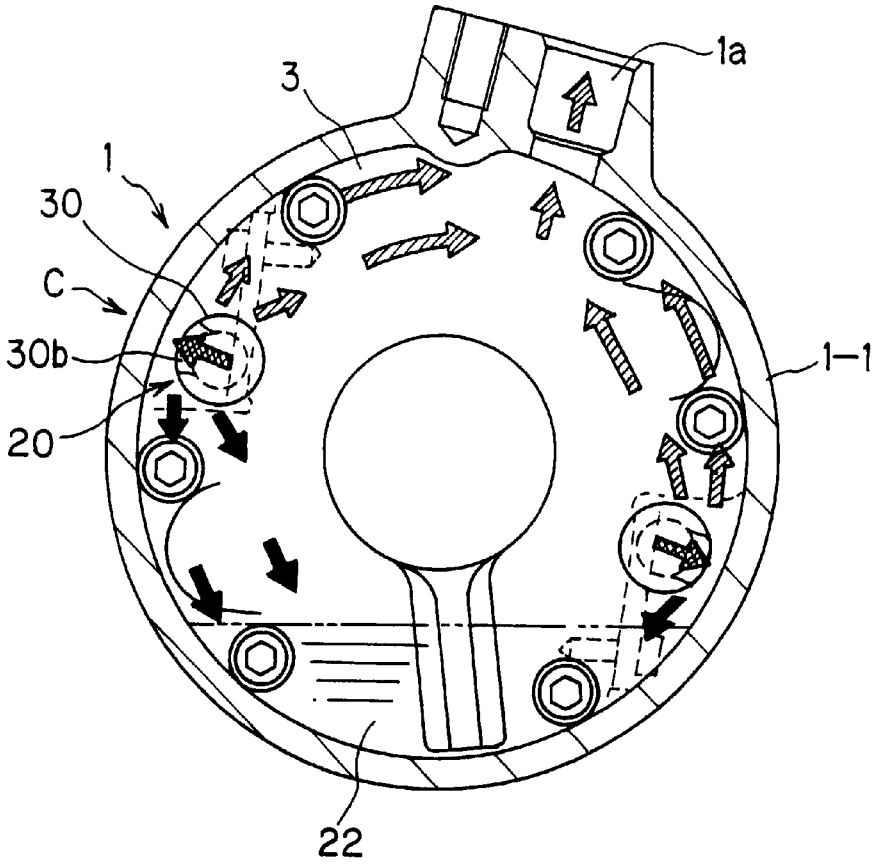
FIG. 9 is a cross-sectional view taken along the line 9—9 of FIG. 8.
Figure 10:
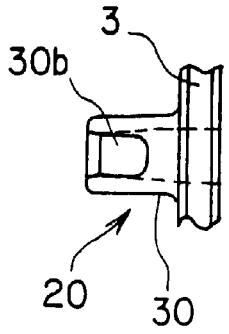
FIG. 10 is a view in the direction indicated by an arrow C in FIG. 9.
Figure 11:
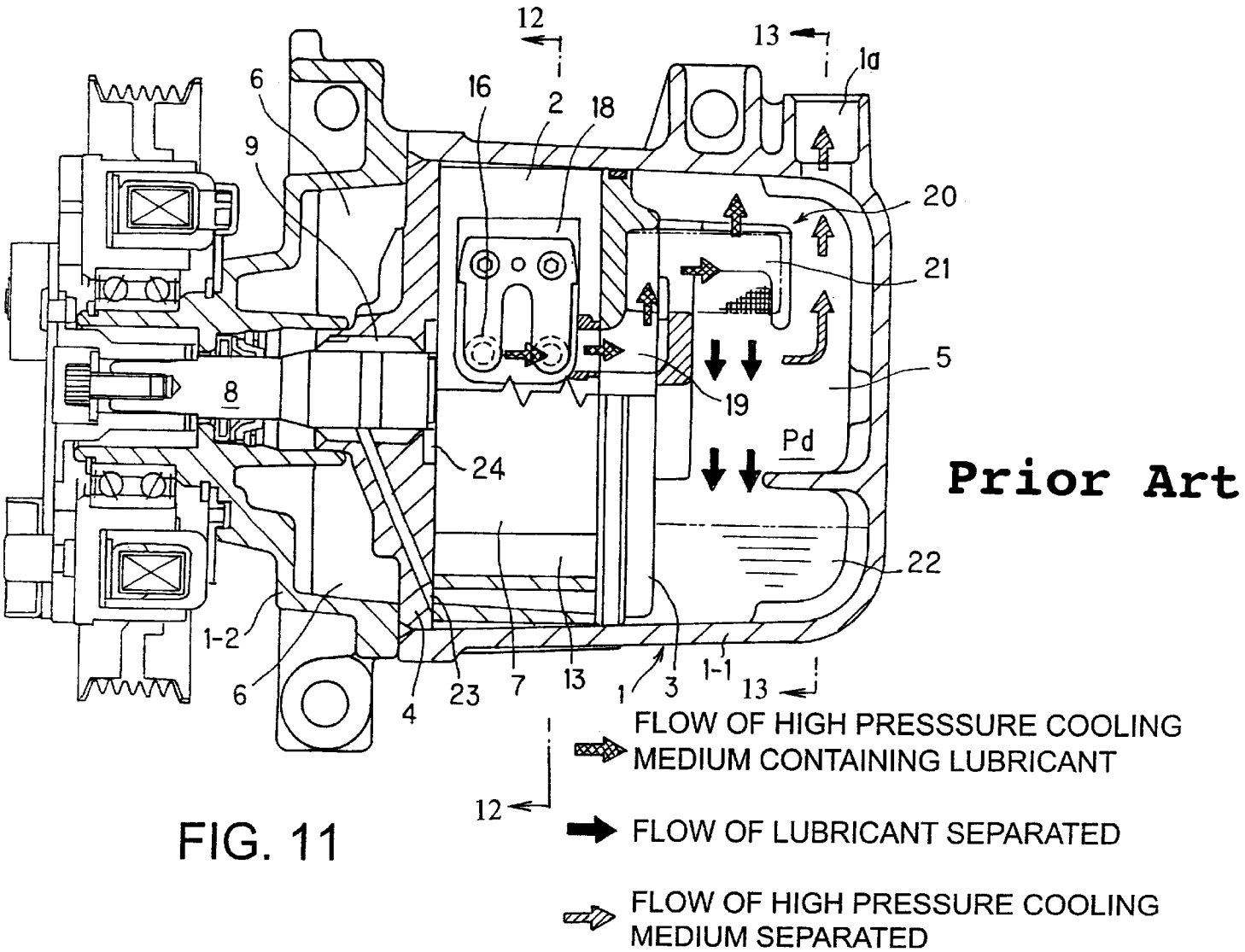
FIG. 11 is a cross-sectional view of a conventional gas compressor.

Also, in the above-described embodiment, the straight tube, 30-1 is adapted as the means for colliding the high pressure cooling medium gas at a high flow rate against the compressor case 1 inner wall avoiding the bypass of the discharge route. However, instead thereof, as shown in FIG. 8, it is possible to use the discharge pipe 30 that is short in length in comparison with the above-described embodiment. In this structure, one end 30*a* of the discharge pipe 30 is opened to the side of the first discharge chamber 18 in the same manner as in the above-described embodiment. However, as shown in FIG. 9, the other end 30*b* of the discharge pipe 30 is adapted to open toward the inner wall portion of the compressor case 1 at the closest position immediately after the first discharge chamber 18 (See FIG. 10). This is because, as described above, the distance to the inner wall of the compressor case 1 is shortened whereby a larger amount of high pressure cooling medium gas is collided against the inner wall of the compressor case 1 without decreasing the flow rate.

In the gas compressor according to the present invention, as described above, the oil separator having the pipe structure composed only of the discharge pipe provided integrally with the side block, it is unnecessary to use the seal members such as the oil separator filter, the oil separator fastening bolts, the O-ring as in the conventional oil separator for the structure. It is possible to reduce the number of these parts and to reduce the number of the steps for assembling the oil separator on the compressor manufacturing line to make it possible to reduce the cost for overall equipment.

Also, in the gas compressor according to the present invention, as described above, since one of the side block and the discharge pipe are formed into an integral cast article, there is no portion from which the high pressure cooling medium gas leaks before the oil separation or in which the oil separator fastening bolts are loosened as in the conventional oil separator. Since the discharge route for the high pressure cooling medium gas without any bypass immediately before the inner wall of the compressor case from the first discharge chamber, the high pressure cooling medium gas at a high flow rate is caused to collide against the inner wall of the compressor case through this discharge route and the like, it is possible to effectively separate the lubricant oil component contained in the high pressure cooling medium gas and at the same time to keep the oil separation performance thereof constant for a long period of time.

What is claimed is:

1. A gas compressor comprising:

a compressor case having an inner end wall portion at an inner sealed end thereof;

a cylinder disposed in the compressor case;

a pair of side blocks mounted on end surfaces of the cylinder;

a compression chamber disposed in the cylinder for receiving a high pressure cooling medium gas containing a lubricant oil component;

a first discharge chamber in communication with the compression chamber;

a cylinder discharge port for discharging the high pressure cooling medium gas containing the lubricant oil component from the compression chamber to the first discharge chamber;

a second discharge chamber disposed between the inner sealed end of the compressor case and a first one of the side blocks for receiving from the first discharge chamber the high pressure cooling medium gas and lubricant oil component; and an oil separator comprised of a discharge pipe for separating the lubricant oil component from the high pressure cooling medium gas, the discharge pipe having a first open end connected to the first side block in fluid communication with the first discharge chamber and a second open end through which the high pressure cooling medium gas containing the lubricant oil component exits into the second discharge chamber, the second open end of the discharge pipe opening in a direction towards and disposed proximate to the inner end wall portion of the compressor case so that the high pressure cooling medium gas containing the lubricant oil component collides with the inner wall portion of the compressor case immediately after exiting from the second open end of the discharge pipe to separate the lubricant oil component from the high pressure cooling medium gas.

2. A gas compressor according to claim 1; wherein the first side block and the discharge pipe are cast integrally with each other.

3. A gas compressor according to claim 1; wherein the first side block has a press-fit hole in communication with the first discharge chamber; and wherein the first open end of the discharge pipe is press-fitted in the press-fit hole of the first side block.

4. A gas compressor according to claim 1; wherein the first side block has a screw hole in communication with the first discharge chamber; and wherein the discharge pipe has a screw portion formed in an outer circumferential surface of the first open end thereof for threaded engagement with the screw hole of the first side block to connect the discharge pipe to the first side block.

5. A gas compressor according to claim 1; wherein a distance from the second open end of the discharge pipe to the inner end wall portion of the compressor case is not smaller than 5 mm and not larger than 10 mm; and wherein a diameter of the second open end of the discharge pipe is not smaller than 4 mm and not larger than 10 mm.

6. A gas compressor according to claim 1; wherein the second open end of the discharge pipe does not open in a direction toward inner upper and lower wall portions of the compressor case.

7. A gas compressor according to claim 1; wherein the discharge pipe extends into the second discharge chamber so that the high pressure cooling medium containing the lubricant oil component flows from the first discharge chamber through the discharge pipe and exits the second open end of the discharge pipe in a direction generally perpendicular to the inner end wall portion of the compressor case.

8. A gas compressor according to claim 1; wherein the first and second open ends of the discharge pipe are the only open ends of the discharge pipe.

9. A gas compressor according to claim 1; wherein the second open end of the discharge pipe has a single opening.

10. A gas compressor comprising:

a compressor case having an inner end wall portion at an inner sealed end thereof;

a cylinder disposed in the compressor case;

a pair of side blocks mounted on end surfaces of the cylinder;

a compression chamber disposed in the cylinder for receiving a high pressure cooling medium gas containing a lubricant oil component;

a pair of first discharge chambers in communication with the compression chamber;

a cylinder discharge port for discharging the high pressure cooling medium gas containing the lubricant oil component from the compression chamber to the first discharge chambers;

a second discharge chamber disposed between the inner sealed end of the compressor case and a first one of the side blocks for receiving from the first discharge chambers the high pressure cooling medium gas and lubricant oil component; and an oil separator comprised of two discharge pipes for separating the lubricant oil component from the high pressure cooling medium gas, each of the discharge pipes having a first open end connected to the first side block in fluid communication with a respective one of the first discharge chambers and a second open end opening in a direction towards the inner end wall portion of the compressor case.

11. A gas compressor according to claim 10; wherein each of the discharge pipes provides a discharge route for the high pressure cooling medium gas without any bypass from a respective one of the first discharge chambers to a position immediately before the inner end wall portion of the compressor case.

12. A gas compressor according to claim 10; wherein each of the discharge pipes comprises a straight tubular member extending linearly from a respective one of the first discharge chambers toward the inner end wall portion of the compressor case.

13. A gas compressor according to claim 10; wherein the first open end of each of the discharge pipes opens in a direction toward a respective one of the first discharge chambers; and wherein the second open end of each of the discharge pipes opens in a direction toward the inner end wall portion of the compressor case at a position immediately after a corresponding one of the first discharge chambers.

14. A gas compressor according to claim 10; wherein the first side block and the two discharge pipes are cast integrally with each other.

15. A gas compressor according to claim 10; wherein the first side block has two pipe press-fit holes each disposed in communication with a respective one of the first discharge chambers; and wherein the second open end of each of the discharge pipes is press-fitted in a corresponding one of the press-fit holes of the first side block.

16. A gas compressor according to claim 10; wherein the first side block has two screw holes each disposed in communication with a respective one of the first discharge chambers; and wherein each of the discharge pipes has a screw portion formed in an outer circumferential surface of the second open end thereof for threaded engagement with a respective one of the screw holes of the first side block to connect the discharge pipes to the first side block.

17. A gas compressor according to claim 10; wherein a distance from the second open end of each of the discharge pipes to the inner end wall portion of the compressor case is not smaller than 5 mm and not larger than 10 mm; and wherein a diameter of each of the second open end of the discharge pipes is not smaller than 4 mm and not larger than 10 mm.

18. A gas compressor according to claim 10; wherein the second open end of each of the discharge pipes does not open in a direction toward inner upper and lower wall portions of the compressor case.

19. A gas compressor according to claim 10; wherein each of the discharge pipes extends into the second discharge chamber so that the high pressure cooling medium containing the lubricant oil component flows from the first discharge chamber through the discharge pipe and exits the second open end of the discharge pipe in a direction generally perpendicular to the inner end wall portion of the compressor case.

20. A gas compressor according to claim 10; wherein the first and second open ends of each of the discharge pipes are the only open ends of the discharge pipe.

21. A gas compressor according to claim 10; wherein the second open end of each of the discharge pipes has a single opening.

22. A gas compressor comprising:

a compressor case having an inner end wall portion;

a mounting block mounted in the compressor case;

a compression chamber disposed in the compressor case for receiving a high pressure cooling medium gas containing a lubricant oil component;

at least one first discharge chamber in fluid communication with the compression chamber;

a discharge port for discharging the high pressure cooling medium gas containing the lubricant oil component from the compression chamber to the first discharge chamber;

a second discharge chamber disposed between the inner end wall portion of the compressor case and the mounting block for receiving from the first discharge chamber the high pressure cooling medium gas and lubricant oil component; and at least one tubular member formed in one piece with the mounting block and extending into the second discharge chamber for separating the lubricant oil component from the high pressure cooling medium gas, the tubular member having a first opening connected to the mounting block in fluid communication with the first discharge chamber and a second opening disposed opposite to the first opening and proximate the inner end wall portion of the compressor case so that the high pressure cooling medium gas containing the lubricant oil component enters the tubular member through the first opening from the first discharge chamber and exits the tubular member only through the second opening in a direction towards the inner end wall portion of the compressor case so that the high pressure cooling medium gas containing the lubricant oil component collides with the inner wall portion of the compressor case immediately after exiting from the second open end of the discharge pipe to separate the lubricant oil component from the high pressure cooling medium gas.

23. A gas compressor according to claim 22; wherein a distance from the second opening of the discharge member to the inner end wall portion of the compressor case is within a range of 5 mm to 10 mm; and wherein a diameter of the second opening of the tubular member is within a range of 4 mm to 10 mm.

* * * * *